US007918371B2

(12) United States Patent
Wilson

(10) Patent No.: US 7,918,371 B2
(45) Date of Patent: Apr. 5, 2011

(54) DUAL AMMUNITION MAGAZINE POUCH

(76) Inventor: Stuart M. Wilson, Camano Island, WA (US)

( * ) Notice: Subject to any disclaimer, the term of this patent is extended or adjusted under 35 U.S.C. 154(b) by 934 days.

(21) Appl. No.: 11/803,002

(22) Filed: May 11, 2007

(65) Prior Publication Data

US 2008/0277436 A1 Nov. 13, 2008

(51) Int. Cl.
*F42B 39/02* (2006.01)

(52) U.S. Cl. ..... 224/196; 224/239; 224/931

(58) Field of Classification Search ..... 224/196, 224/676, 681, 239, 245, 246, 931, 250, 251; D3/292

See application file for complete search history.

(56) References Cited

U.S. PATENT DOCUMENTS

| | | | | | |
|---|---|---|---|---|---|
| 900,094 | A * | 10/1908 | Fisher | 224/681 |
| 3,212,689 | A * | 10/1965 | Woolfolk | 206/3 |
| 4,613,068 | A * | 9/1986 | Bianchi | 224/242 |
| 4,932,576 | A * | 6/1990 | Ashley | 224/673 |
| 5,152,442 | A * | 10/1992 | Gallagher | 224/245 |
| 5,174,482 | A | 12/1992 | Roger et al. | |
| 6,202,908 | B1 * | 3/2001 | Groover | 224/239 |
| 6,305,540 | B1 * | 10/2001 | Crawford et al. | 206/320 |
| 6,749,099 | B2 * | 6/2004 | Danielson | 226/149 |
| 6,874,618 | B1 | 4/2005 | Cragg | |
| 7,100,810 | B1 * | 9/2006 | Bosch et al. | 224/682 |

* cited by examiner

*Primary Examiner* — Justin M Larson
(74) *Attorney, Agent, or Firm* — R. Tracy Crump

(57) ABSTRACT

The dual magazine pouches allows one of the two magazines to be partially ejected from the pouch automatically when the pouch is opened so that a shooter has quick and easy access to the magazine yet the remaining magazine is retained securely within the pouch. The pouches include a main body formed by a cargo pocket sewn to a back/flap, which extends above the cargo pocket and folds over to enclose the open mouth of the pouch, and an "elevator" mechanism, which automatically raises one of the magazine when the pouch is opened. The "elevator" mechanism is provided by two elastic members: an elastic retention band and an elastic "elevator" band or cord. The retention band snugly holds a first ammunition magazine against the back/flap when fully inserted into the pouch. The elevator band forms a "saddle" within which a second ammunition magazine sits. Fully inserting the second magazine stretches the elevator band. When both ammunition magazines are fully inserted into the pouch, the back/flap is folded over the tops of the magazines and secured by hook and loop patches. When the back/flap is lifted, the tension from the elevator band automatically lifts the second magazine partially ejecting it from the pouch above the exposed top of the first magazine.

5 Claims, 11 Drawing Sheets

DUAL AMMUNITION MAGAZINE POUCH

This invention relates to firearm ammunition magazine pouches and more particularly magazine pouches for carrying more than one magazine.

BACKGROUND OF THE INVENTION

Persons armed with firearms generally like to carry additional ammunition, preferably in a magazine which can be readily loadable into the firearm. It has long been necessary for a shooter to carry additional ammunition magazines in holsters or specialized pouches mounted to a waist belt, tactical vest, chest rig or load bearing equipment worn by the shooter. The speed and convenience of accessing and drawing the magazine and drawing from the pouch is critical for any ammunition pouch design.

Military style ammunition pouches typically are constructed of cotton canvas or nylon fabrics and are designed to carry a particular size or type of ammunition magazine. These pouches, the magazines are inserted and carried vertical into the open mouth of the pouch body and covered with a flap that is secured by a snap, buckled or mating velcro patches. When the pouch flap is lifted, the top of the magazines ride above the pouch body allowing the shooter access to grasp the magazine and draw it from the pouch. Dual magazine pouches simply accept two magazines stacked flat against one another inside the pouch. To prevent the magazines from rattling around inside the pouch, the pouches are dimensioned to fit two magazines snugly within the pouch body.

One serious drawback to the standard military style dual magazine pouch is that it is often difficult to draw a single magazine from the pouch. Because the magazines are seated snuggly within the pouch body, drawing one magazine from the pouch often results in pulling the other magazine along with it. Since only the tops of the magazines extend above the pouch body, each magazine must be individually grasped using primarily the thumb and index finger in a relative fine gross motor skill. In the high stress environment of a firearms engagement when an emergency reload is necessary, a shooter needs to be able to quickly and easily retrieve a single magazine from the pouch and often lacks the fine motor skills needed to draw a single magazine from a tightly stacked and packed conventional dual magazine pouch. This problem is further compounded for shooters who wear gloves, such as military personnel.

SUMMARY OF THE INVENTION

The dual magazine pouches of the present invention allow one of the two magazines to be partially ejected from the pouch automatically when the pouch is opened so that a shooter has quick and easy access to the magazine yet the remaining magazine is retained securely within the pouch. Each pouch embodiment includes a main body formed by a cargo pocket sewn to a back/flap, which extends above the cargo pocket and folds over to enclose the open mouth of the pouch. Each pouch embodiment also includes an "elevator" mechanism, which automatically raises one of the magazines when the pouch is opened. The "elevator" mechanism is provided by two elastic members: an elastic retention band and an elastic "elevator" band or cord. The retention band is sewn to the inner face of the back/flap adjacent the pouch mouth. The retention band snuggly holds a first ammunition magazine against the back/flap when fully inserted into the pouch. The elevator band is oriented vertically with one end of the band sewn to the front of the retention band and the other end sewn to the inner face of the cargo pocket. The elevator band forms a "saddle" within which a second ammunition magazine sits. Fully inserting the second magazine stretches the elevator band. When both ammunition magazines are fully inserted into the pouch, the back/flap is folded over the tops of the magazines and secured by hook and loop patches. When the back/flap is lifted, the tension from the elevator band automatically lifts the second magazine partially ejecting it from the pouch above the exposed top of the first magazine. The "elevator" mechanism automatically raises one of the magazines so that a shooter can easily grasp and fully extract it from the pouch while the remaining magazine remains secure inside the pouch. When only one magazine is carried in the pouch, the retention band retains the magazine against the back/flap preventing it from rattling around inside the pouch.

Theses and other advantages of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 1:
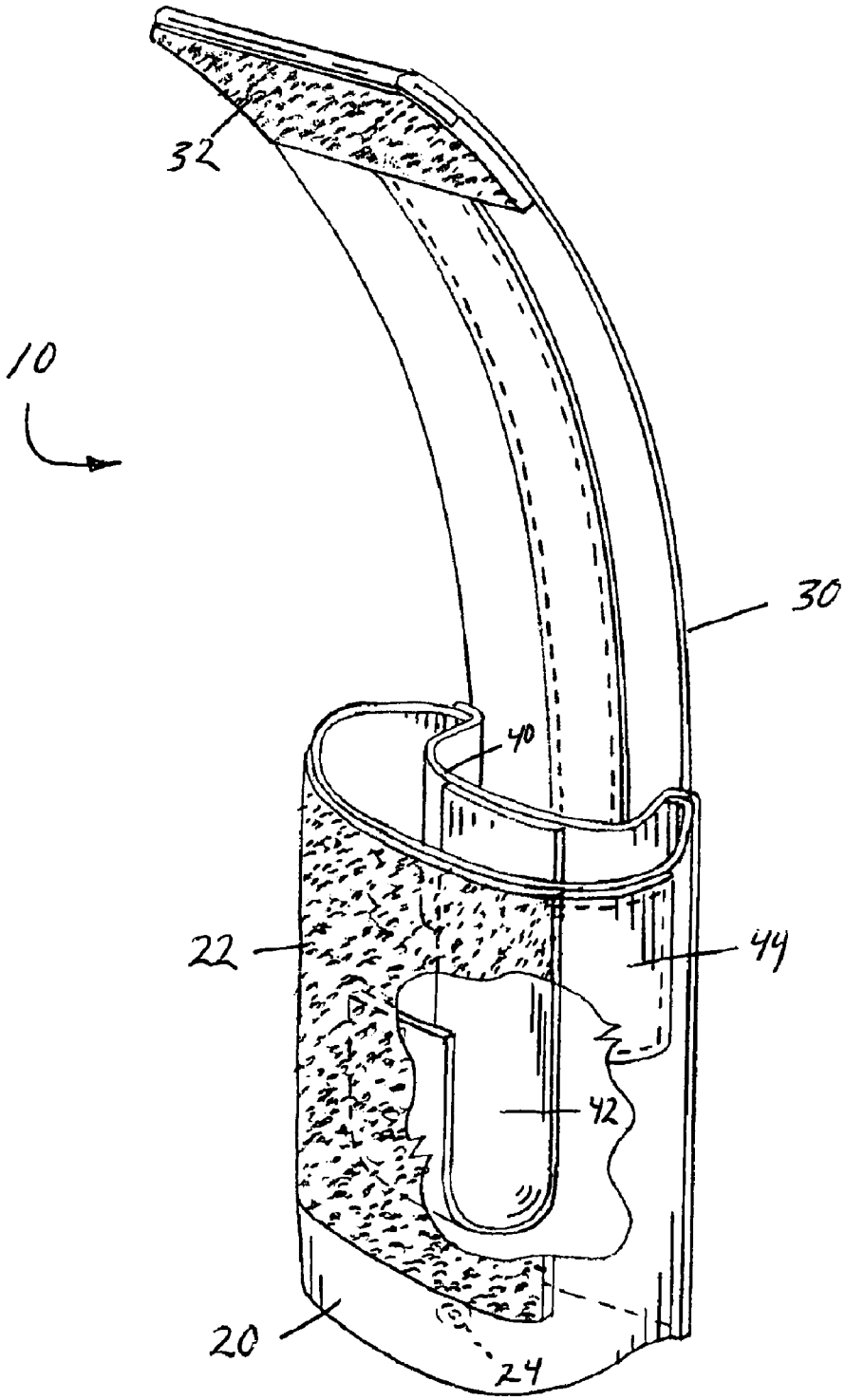
FIG. 1 is a perspective view with a cutaway portion of one embodiment of the dual magazine pouch of this invention.
Figure 2:
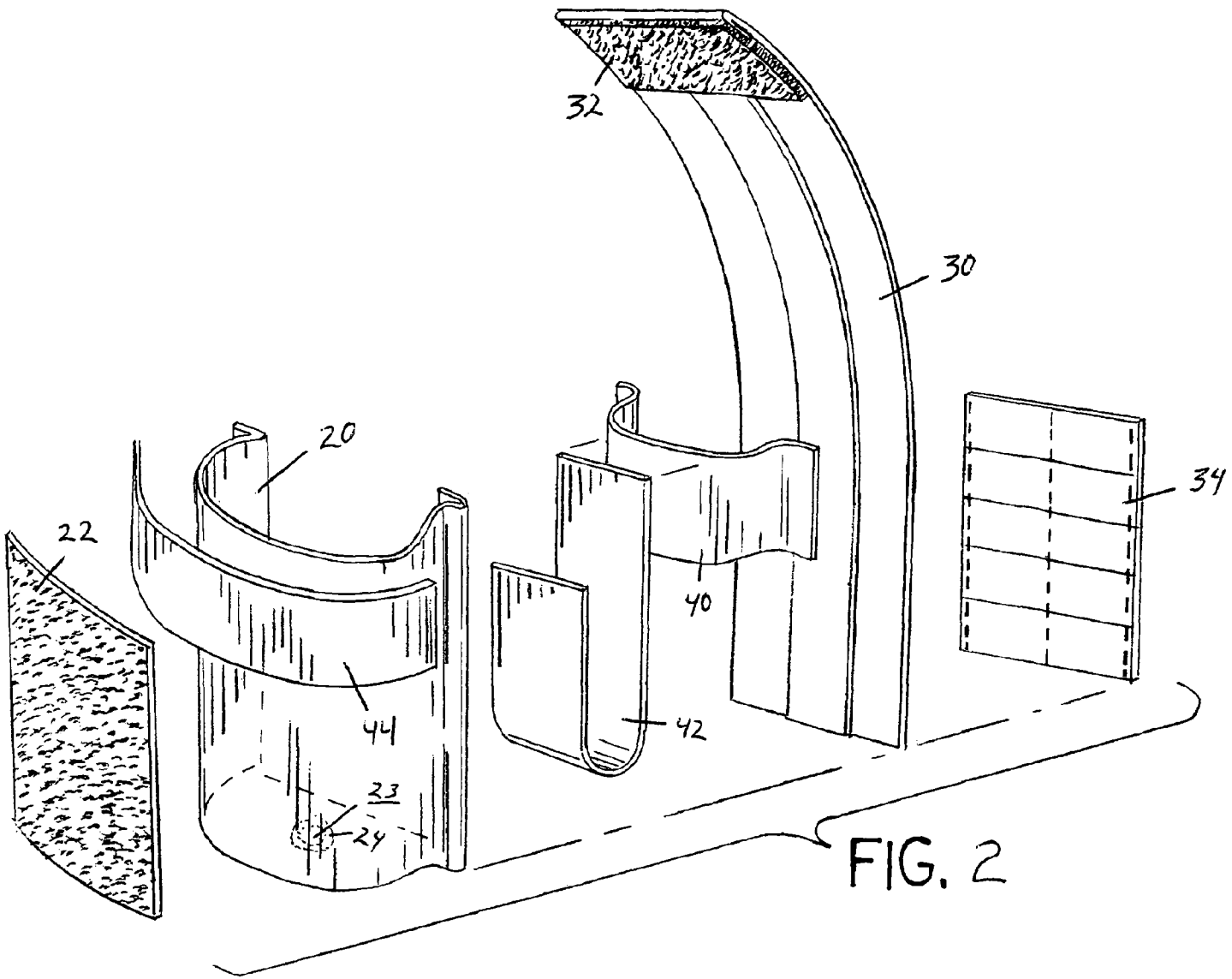
FIG. 2 is an exploded view of the dual magazine pouch of FIG. 1.
Figure 3:
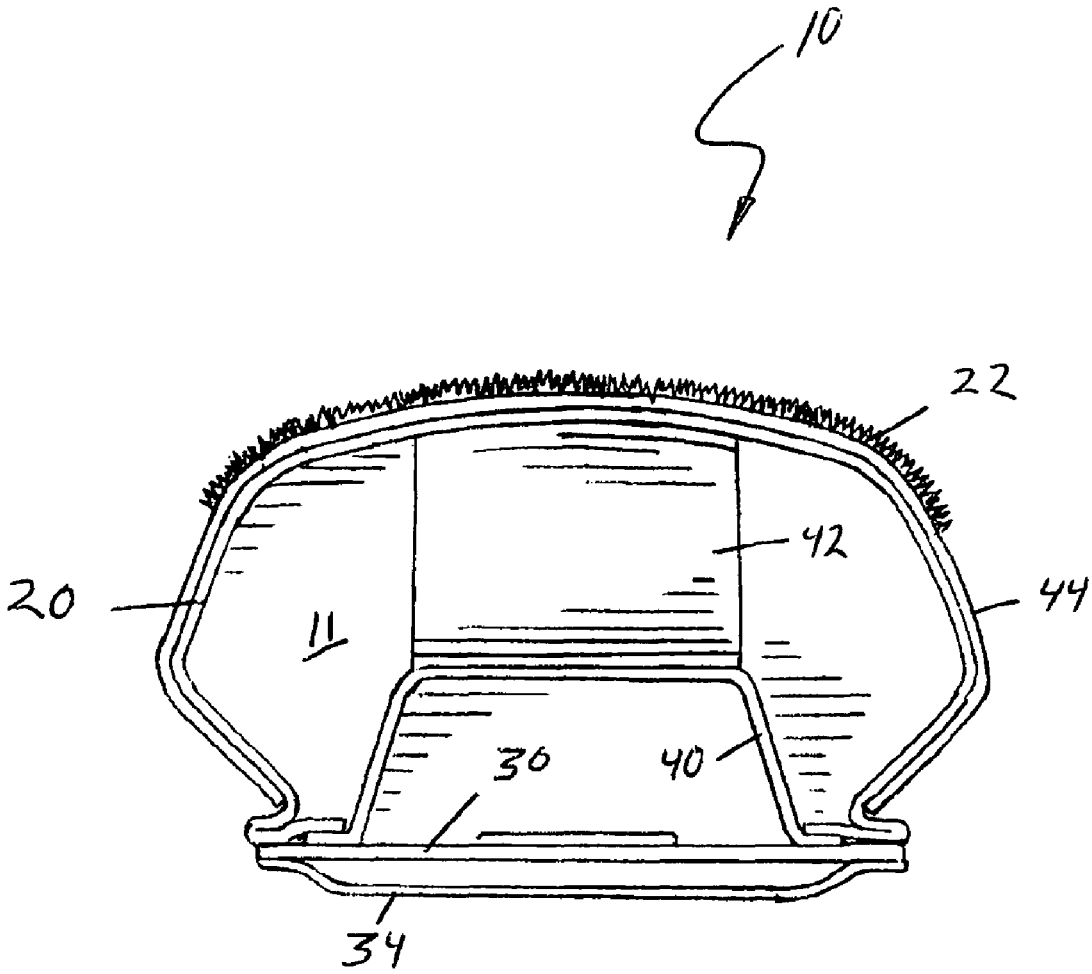
FIG. 3 is a top view of the dual magazine pouch of FIG. 1.
Figure 4:
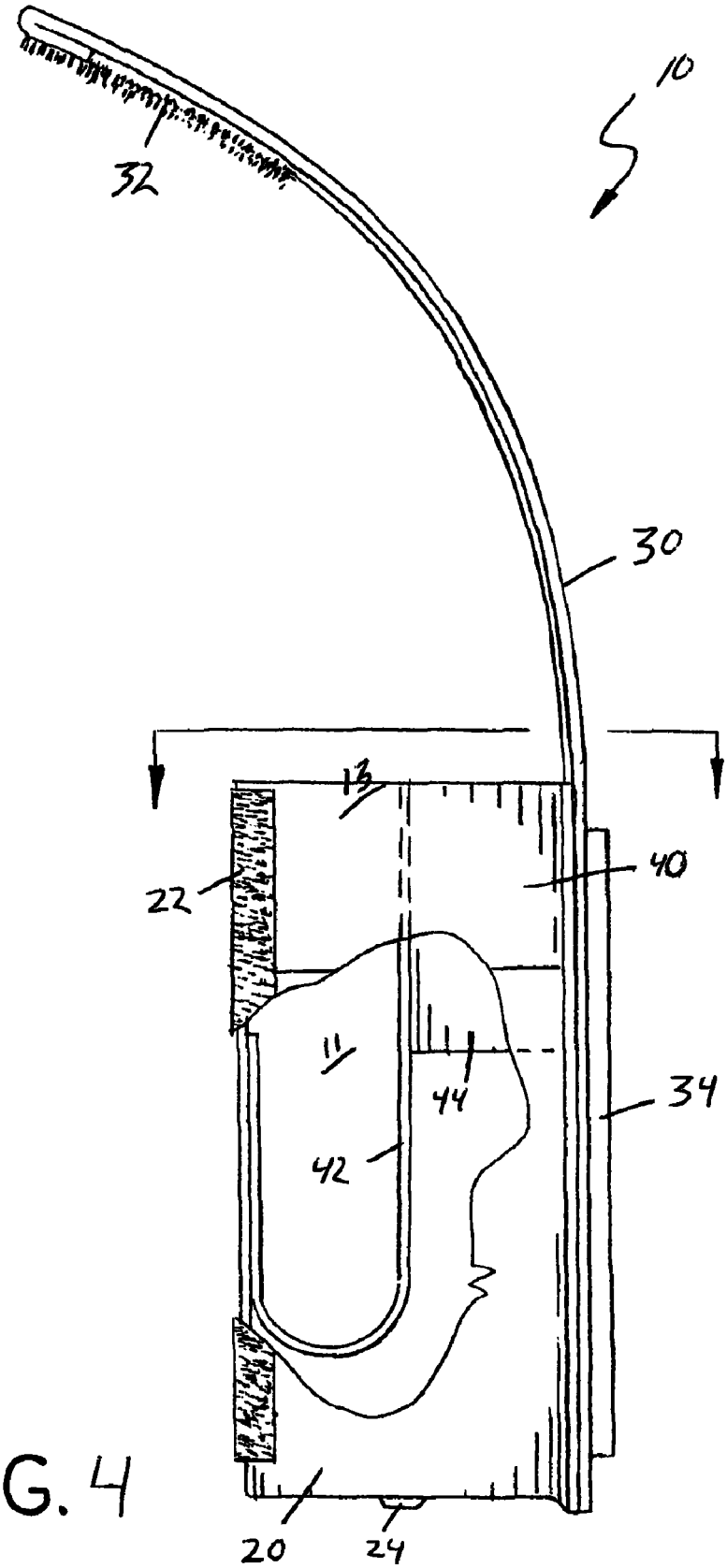
FIG. 4 is a side view of the dual magazine pouch of FIG. 1, showing a cutaway portion to reveal the interior elastic webbing.

For simplicity of illustration and explanation, the dual magazine pouches embodying the present invention herein are shown with conventional 30 round M16 or M4 magazines; however, the dual ammunition pouches of this invention may be sized and adapted for use with pistol, rifle or sub-machine gun magazines within the teachings of this invention. Also, the dual magazine pouches embodying the present invention may be adapted to carry two ammunition magazine regardless of the type of firearm magazine, but may be modified to carry more than two magazines per pouch.

Each embodiment of the dual magazine pouch of this invention has certain common features. Each pouch embodiment incorporates an elevator mechanism, which automatically raises the outer magazine when the pouch is opened while retaining the inner magazine snug inside the pouch. Ideally each pouch embodiment is made from a nylon fabric, such as Cordura® from INVISTA, but can be made from any natural or synthetic cloth or fabric, which resists tears, abrasions and scuffs. The weight of the fabric for the pouch body is selected to provide sufficient rigidity to support two fully loaded ammunition magazines, but soft and pliable enough to be worn comfortably on a shooter's body.

Each pouch embodiment also includes woven PALS (pouch attachment Ladder System) webbing to be MOLLE (MOdular Lightweight Load-carrying Equipment) compatible. The PALS webbing allows the pouches to be attached to other MOLLE compatible vests, packs and pouches. PALS webbing consists of horizontal rows of heavy-duty 1" nylon webbing. PALS webbing allows the pouches to be quick attached to other MOLLE compatible vests, packs and pouches using "Natick" snaps (polyethylene reinforced webbing straps with push the dot snaps for security) or polymer MALICE Clips® 6 from Tactical Tailor (shown in FIG. 13).

FIGS. 1-8 illustrate a first embodiment of the dual magazine pouch of this invention, which is designated generally as reference numeral 10. Pouch 10 has a main body formed by a cargo pocket 20 sewn to an elongated back/flap 30 to define the pouch interior 11. As shown, the fabric of cargo pocket 20 is folded and hemmed to have a front wall, two end walls and a bottom. Back/flap 30 extends above cargo pocket 20 and folds over to enclose the open mouth 13 of pouch 10. As shown, hook and loop (Velcro®) fastening patches 22 and 32 are sewn to the front of cargo pocket 20 and the end of back/flap 30 to close and secure pouch 10. Although hook and loop patches are used to secure the pouch in a closed position, buckles, snaps, buttons, frogs or any other suitable type of fastening method can be used to secure the pouch. PALS webbing 34 is sewn to the back of the back/flap 30. It should also be noted that the bottom of cargo pocket 20 has an opening 23 and a brass grommet 24 to allow sand, dirt and debris to fall through pouch 10.

The elevator mechanism of pouch 10 is provided by two elastic bands: retention band 40 and elevator band 42. Elastic bands 40 and 42 are of conventional design and constructed of polyester covered with natural rubber thread. The width of the bands may vary, but retention band 40 is approximately 1 inch, while the width of elevator band 42 may range between 1 and 2 inches. Retention band 40 is oriented horizontally with its ends sewn to the inner face of back/flap 30 adjacent mouth 13 of pouch 10. Elevator band 42 is oriented vertically and with one end of the band sewn to the front of retention band 40 and the other end sewn to the inner face of cargo pocket 20. As shown, elevator band 42 is sewn between retention band 40 and cargo pocket 20 to form a "saddle" within which a ammunition magazine 4 sits. The elevator mechanism also includes a heavy nylon web 44 sewn across the front face of cargo pocket 20. Ideally, web 44 is a two inch "drive belt" grade and weight nylon web. Web 44 extends horizontally around mouth 13 of pouch 10, but terminates along the end walls of cargo pocket 20 a short distance from back/flap 30. Web 44 is used to hold the open shape of mouth 13 (FIG. 3) when the pouch is empty or carrying only one magazine (FIG. 8) and provide a rigid backing for supporting elevator band 42.

Figure 5:
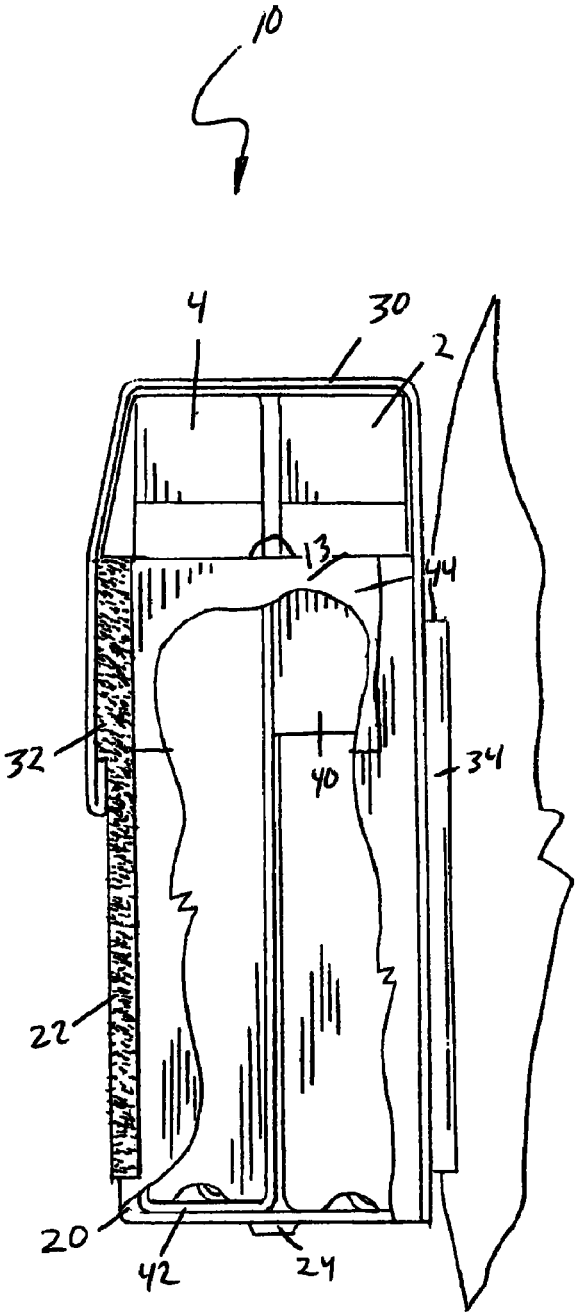
FIG. 5 is a side view with a cutaway portion of the dual magazine pouch of FIG. 1 showing two ammunition magazines carrying within the pouch with the cover flap in a closed position.
Figure 6:
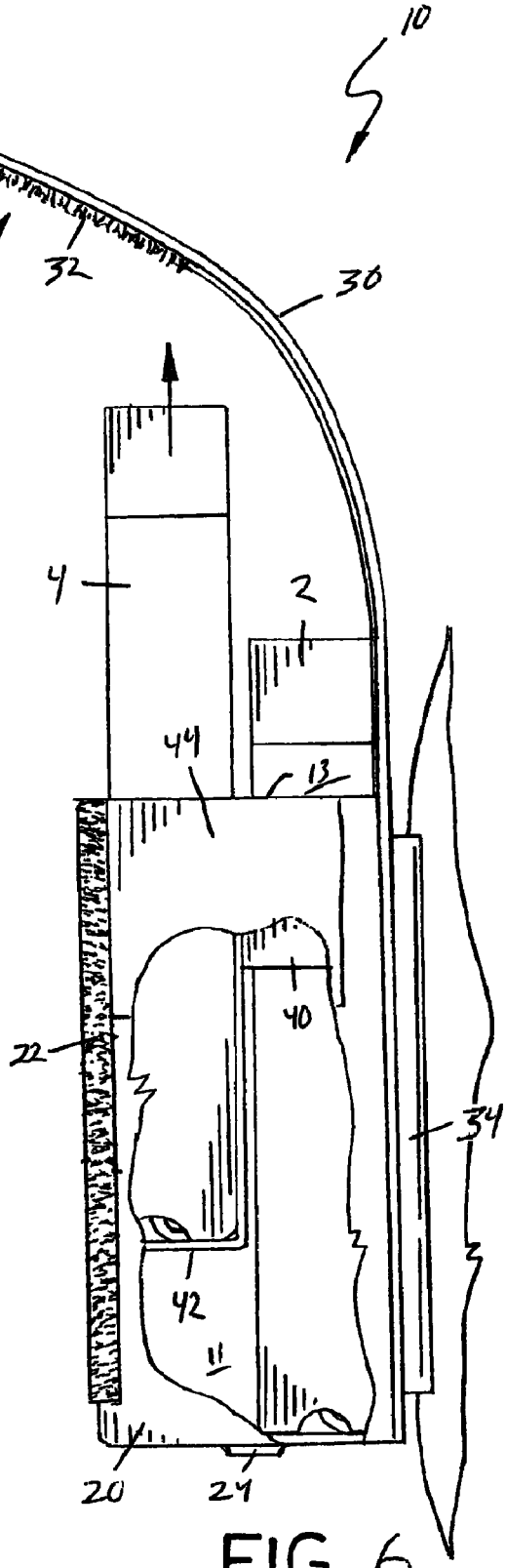
FIG. 6 is a side view with a cutaway portion of the dual magazine pouch of FIG. 1 showing the outer ammunition magazine elevated when the cover flap is in an open position.
Figure 7:
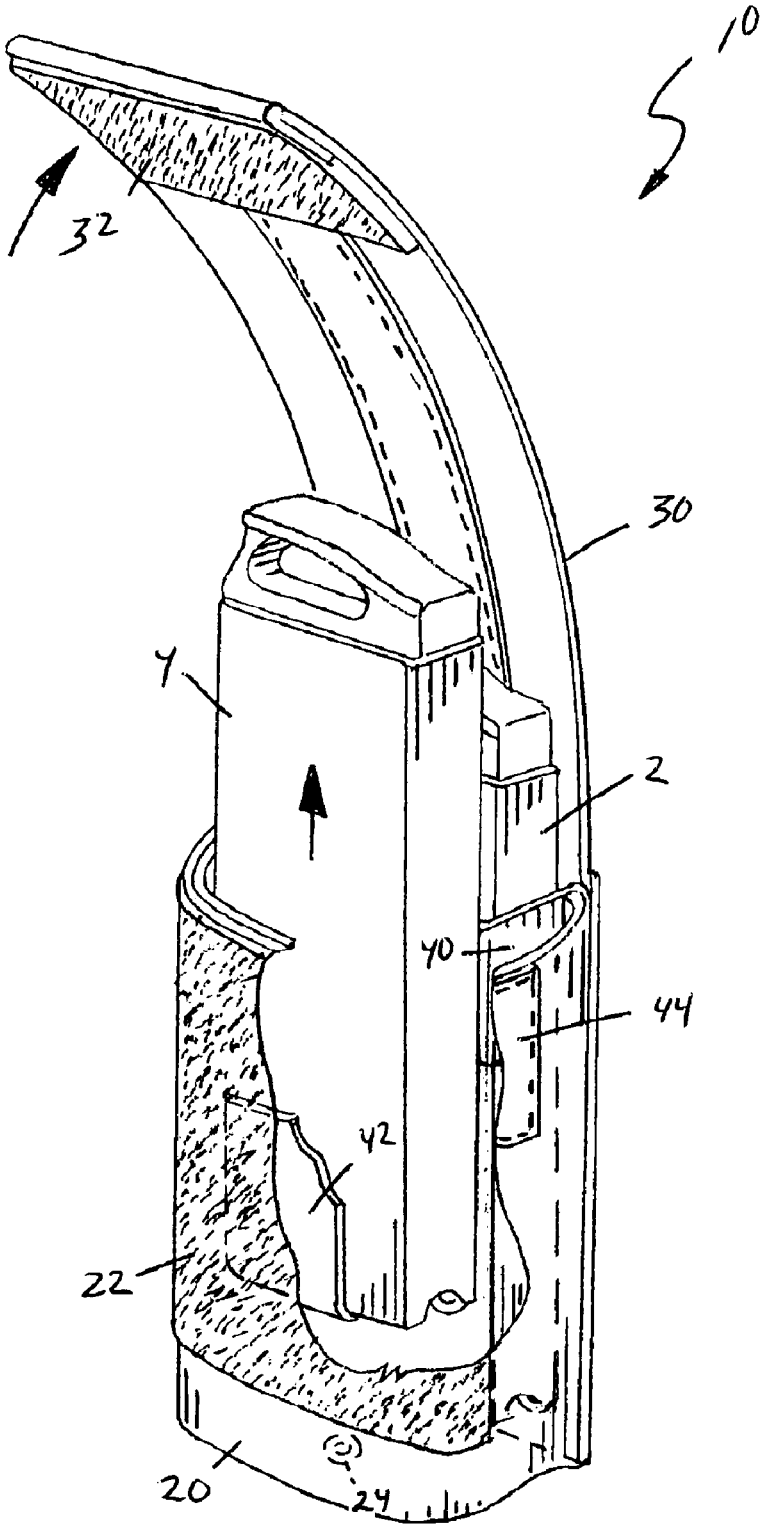
FIG. 7 is a perspective view with a cutaway portion of the dual magazine pouch of FIG. 1 showing the outer ammunition magazine elevated when the cover flap is in an open position.
Figure 8:
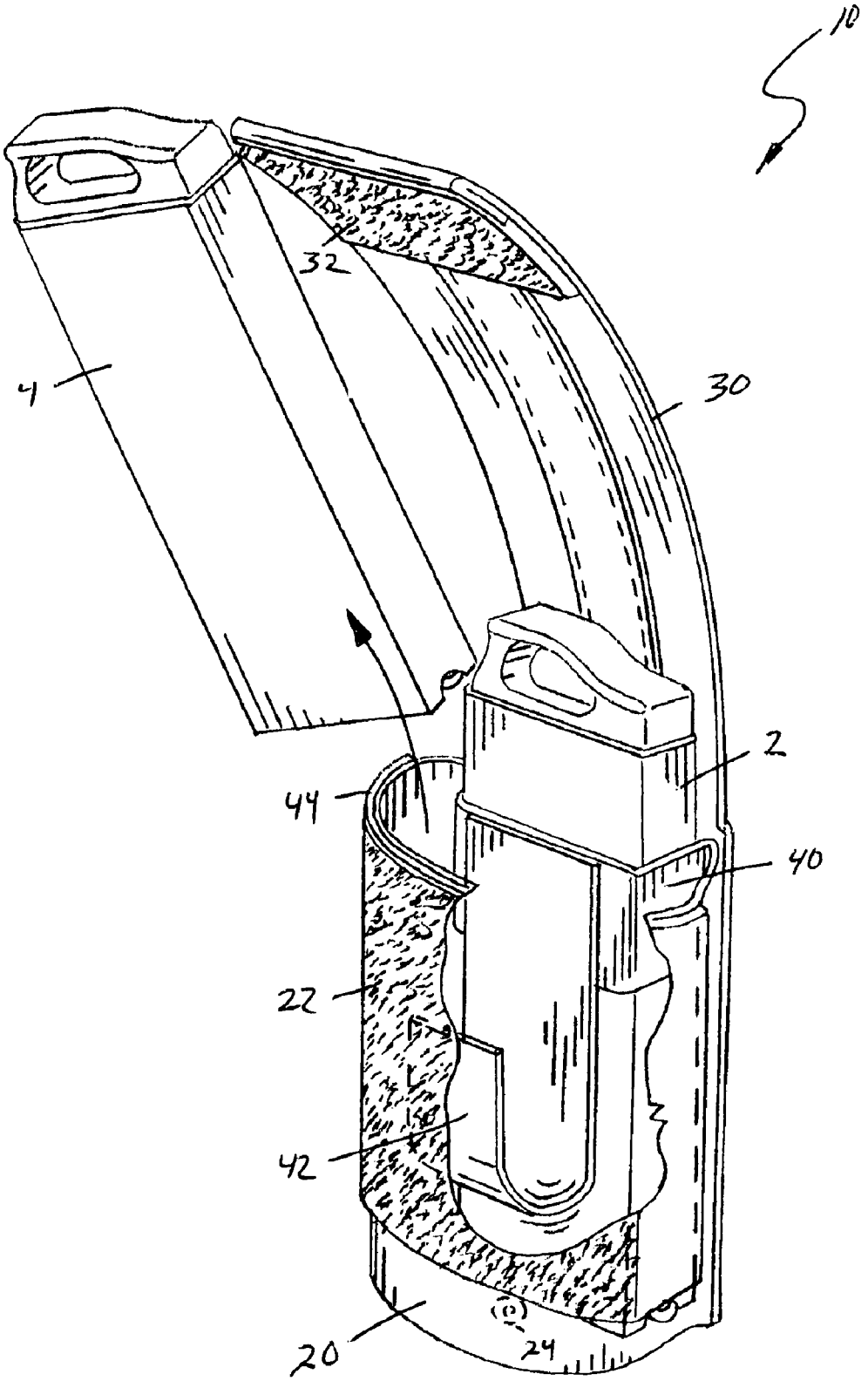
FIG. 8 is a perspective view with a cutaway portion of the dual magazine pouch of FIG. 1 showing the outer ammunition magazine removed within the pouch.

As shown in FIGS. 5-8, the inner ammunition magazine 2 is inserted into pouch 10 and held against back/flap 30 by retention band 40. As best shown in FIG. 5, inner magazine 2 rests against the bottom of cargo pocket 20. Outer ammunition magazine 4 is inserted into pouch 10 and seats atop elevator band 42. As shown in FIG. 5, Pushing magazine 4 is pushed all the way into pouch 10 stretches elevator band 42. When both magazines 2 and 4 are fully inserted into pouch interior 11, the end of back/flap 30 is folded over the tops of the magazines and secured by hook and loop patches 22 and 32. When the end of back/flap 30 is lifted to open pouch 10 in FIGS. 6-8, the tension from elevator band 42 automatically lifts magazine 4 partially from pouch interior 11 above the exposed top of magazine 2. Partially ejected from pouch 10 and elevated above the top of magazine 2, outer magazine 4 is now conveniently exposed for the shooter to grasp and fully extract from pouch 10. With outer magazine 4 removed from pouch 10, the top of inner magazine 2, which is snugly retained within pouch interior 11 by retention band 40, is now conveniently accessible for the shooter to grasp and fully extract from the pouch.

Figure 9:
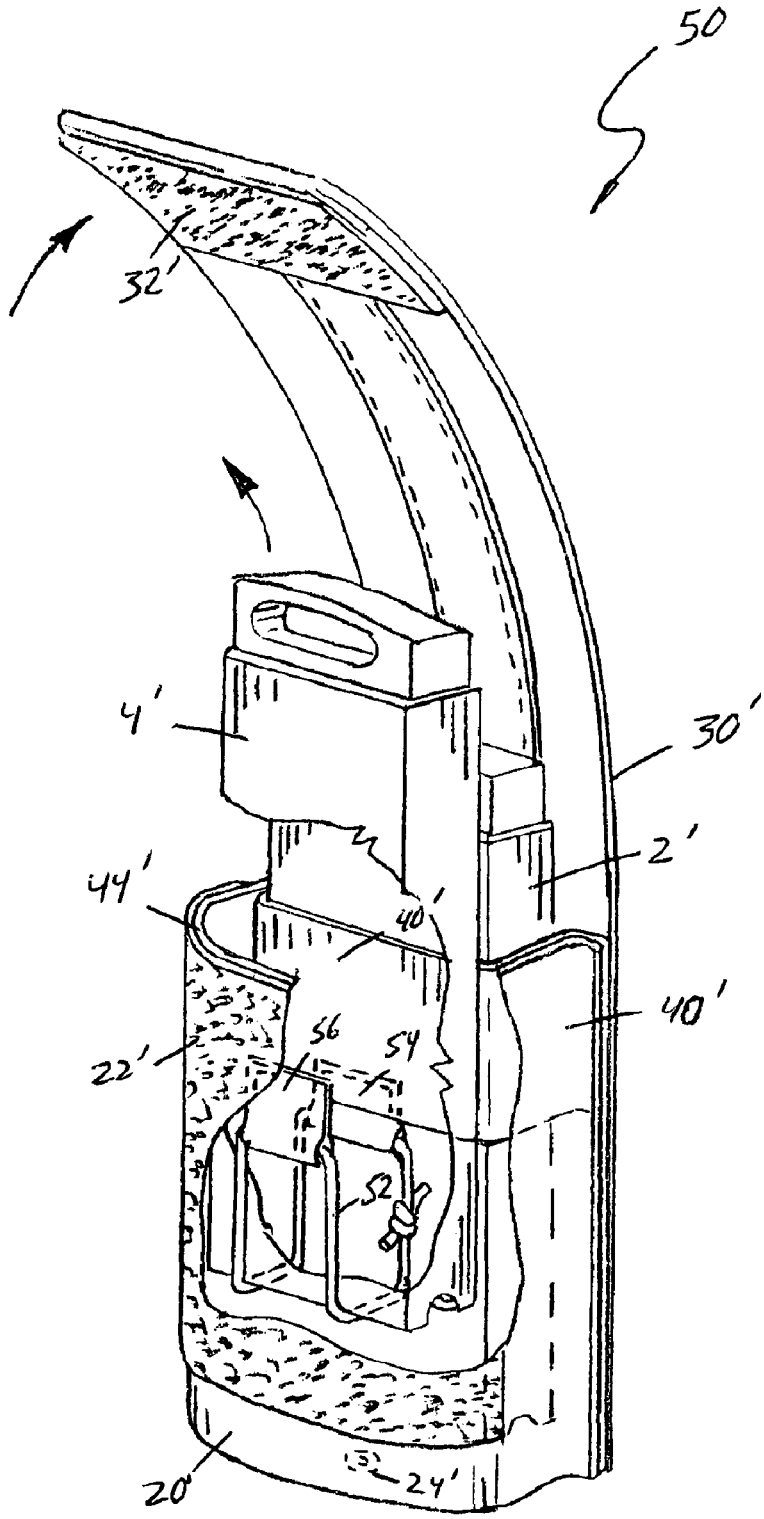
FIG. 9 is a perspective view with a cutaway portion of a second embodiment of the dual magazine pouch of this invention showing the outer ammunition magazine elevated when the cover flap is in an open position.
Figure 10:
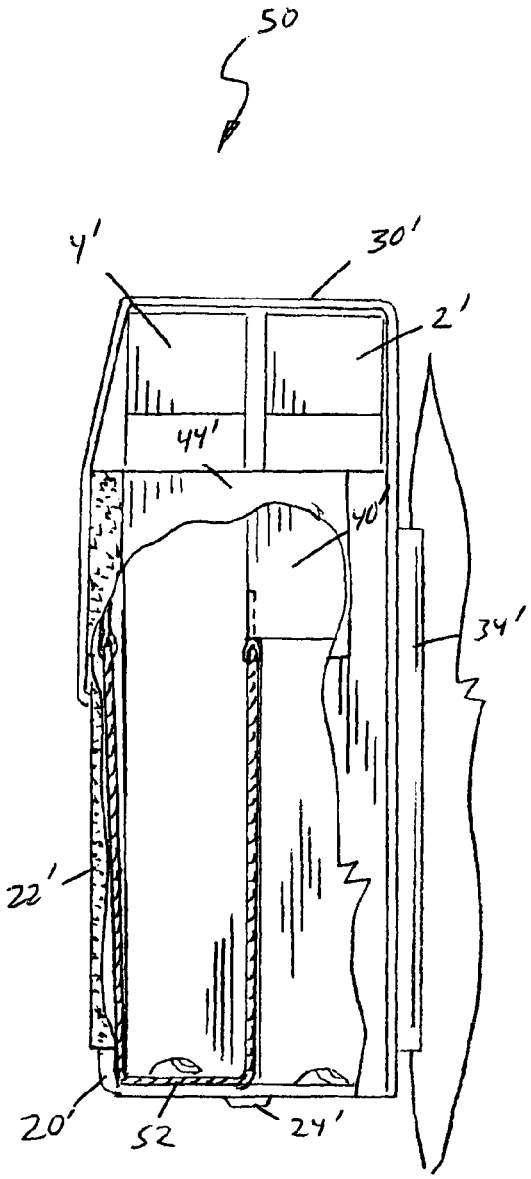
FIG. 10 is a side view with a cutaway portion of the dual magazine pouch of FIG. 9 showing two ammunition magazines carrying within the pouch with the cover flap in a closed position.
Figure 11:
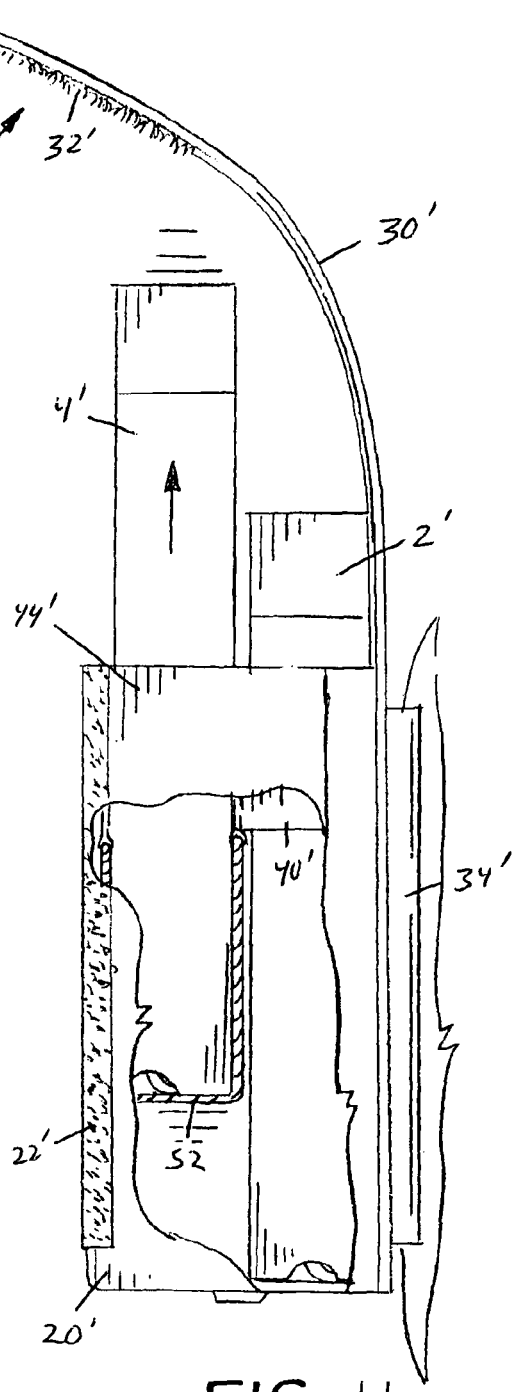
FIG. 11 is a side view with a cutaway portion of the dual magazine pouch of FIG. 9 showing the outer ammunition magazine elevated when the cover flap is in an open position.

FIGS. 9-11 illustrate a second embodiment of the dual magazine pouch of this invention, which is designated generally as reference numeral 50. Pouch 50 is identical in construction to pouch 10, but differs slightly regarding the elevator mechanism. As shown, the elastic elevator band 42 of pouch 10 is replaced with a length of elastic cord 52. Ideally, elastic cord 52 is constructed of continuous rubber strands with an outer nylon sheath. This type of elastic cord is well known and commonly referred to as bungee or shock cord. Elastic cord 52 is selected to be relative thin and pliable, yet provide enough stretch and tension to lift the ammunition magazine from the pouch when opened. Two lengths of nylon webbing 54 and 56 are folded over and sewn to cargo pocket 20' and retention band 40', respectively to form at web loop through which elastic cord 52 runs. The ends of elastic cord 52 are knotted together and the looped elastic cord 52 hangs down within pouch interior 11 to form the saddle, in which the outer magazine sits. It should be noted that the height to which the outer magazine 4' is raised from the pouch can be adjusted by knotting the ends at different lengths. Consequently, the use of elastic cord 52 provides a magazine height and lift tension adjustment feature to pouch 50. In addition, the knotted cord design allows a broken elastic cord 52 to be easily replaced without sewing or altering pouch 50.

Figure 12:
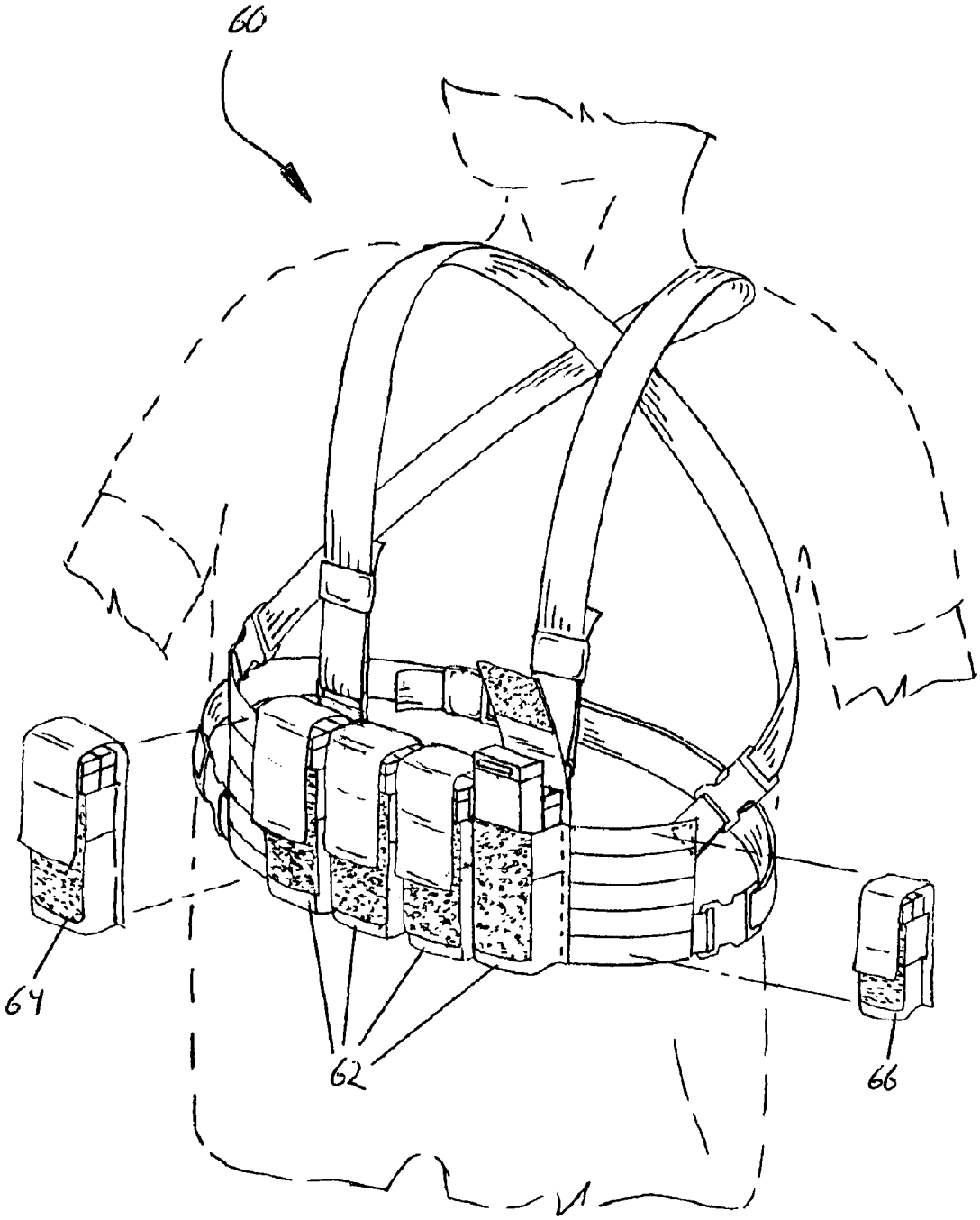
FIG. 12 is a perspective view of a chest rig incorporating multiple dual magazine pouch.

FIG. 12 illustrates the dual magazine pouches of this invention incorporated into a MOLLE compatible chest rig, designated generally as reference numeral 60. Chest rig 60 includes four dual magazine pouches 62 permanently sewn or otherwise attached to the front panel of chest rig 60 with the back/flap 30' extending from the chest rig over the mouth cargo pocket 20'. Chest rig 60 also includes detachable rifle pouches 64 and a smaller detachable pistol magazine pouch 66 connected to the chest rig's PALS webbing.

Figure 13:
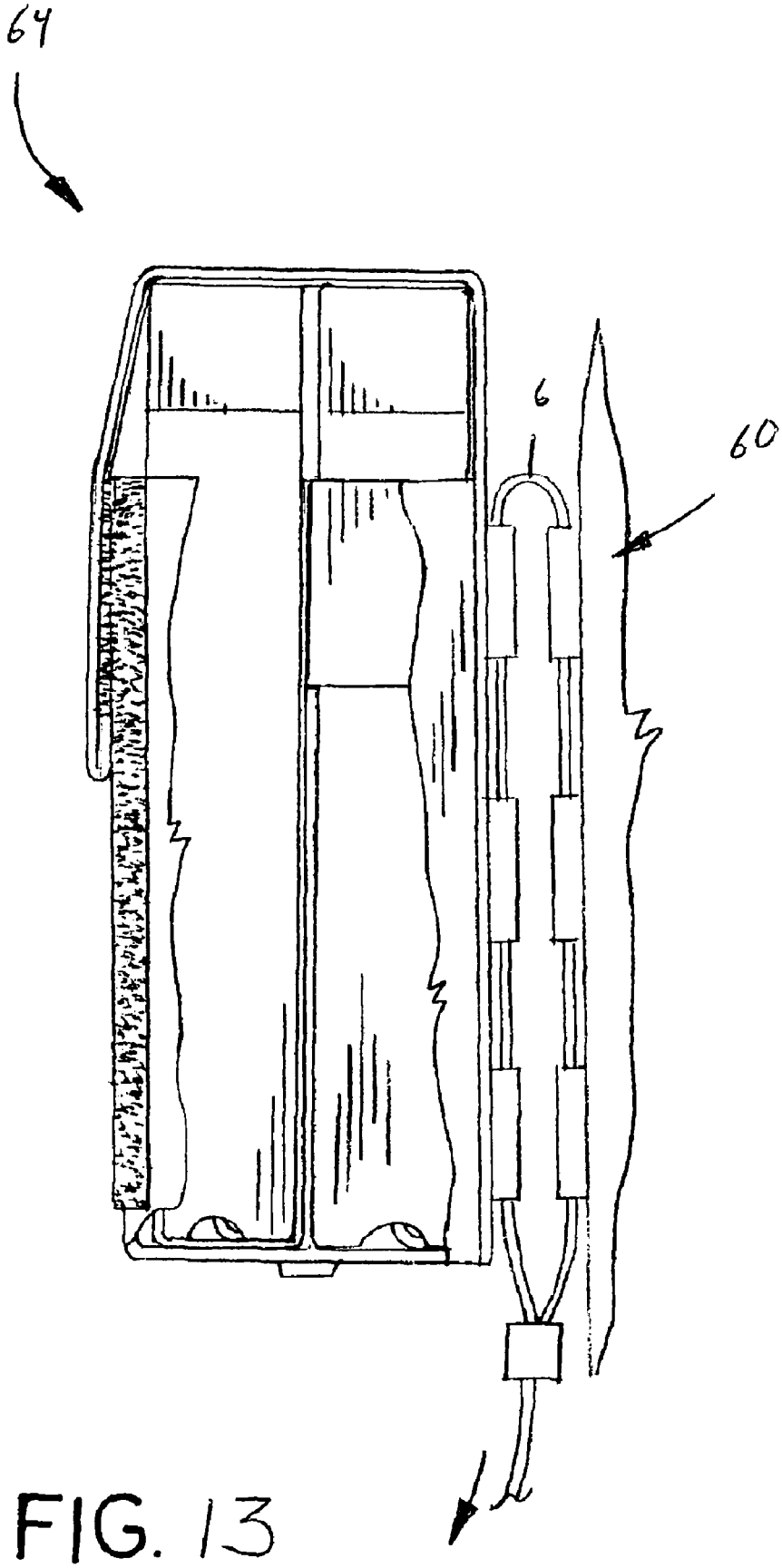
FIG. 13 is a side view of the dual magazine pouch of FIG. 1 showing its connection to a chest rig using the Malice strapping.

FIG. 13 illustrates how Malice straps connect pouches 64 and 66 to the PALS webbing of chest rig 60. Pouches 62, 64 and 66 are all identical in design, construction and function to pouch 10.

Advantages

One skilled in the art will note several advantages of the dual magazine pouches of the present invention. The dual magazine pouch of this invention operates just like a bread toaster with one magazine automatically popping up to be readily accessible when the pouch is opened. Because the elevator band or cord automatically lifts one of the magazines above the other when the pouch is opened, the shooter has quick convenient access to the raised magazine while the other magazine remains nested inside the pouch. With the raised magazine partially ejected from the pouch, more area of the magazine is exposed for the shooter to grasp. The raised magazine can be readily grasped and drawn from the pouch even while wearing gloves. The retention band holds the remaining magazine in place tight against the back/flap and prevents it from rattling about inside the pouch.

The dual magazine pouches of this invention can be adapted to carry any type or size of ammunition magazine, whether rifle, pistol or machine gun. The pouches include PALS webbing making the pouches MOLLE compatible for modularity, but can also be integrated directly into the design of various chest rigs, vests, packs and other products. The "elevator" mechanism used by the pouches of this invention operates using only elastic bands and cords, which make the pouches simple to construct and cost effective. The elevator mechanism can be incorporated into any fabric pouch design without the need for metal springs or plastic pouch inserts.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. An ammunition pouch for carrying a first magazine and a second magazine, the pouch and adapted for modular connection to a chest rig, vest, LBE, other pouch or other carrying platform, the pouch comprising:

an elongated fabric back/flap;

a fabric cargo pocket fixed to the back/flap to define a pouch interior for receiving the first magazine and the second magazine and an open mouth thereof, the back/flap having a flap end adapted to fold over the cargo pocket for covering the open mouth in a closed position and to unfold from the cargo pocket for uncovering the open mouth in an open position;

fastening means for securing the flap end to the cargo pocket in the closed position;

a first elastic member disposed within the pouch interior and having opposite ends affixed to the back/flap for restrictively receiving the second magazine therebetween and against the back/flap;

a second elastic member disposed within the pouch interior and mounted to the first elastic member and the cargo pocket for supporting the first magazine thereon such that the second elastic member stretches when the first magazine is fully seated within the pouch interior and partially ejects the first magazine supported thereon from the pouch interior when the back/flap is in the means for selectively adjusting the length of the second elastic member so as to adjust the height that the first magazine is elevated when the flap end is in the open position, the first elastic member restrictively retaining the second magazine within the pouch interior when the second elastic member partially ejects the first magazine from the pouch interior.

2. The pouch of claim 1 wherein the second elastic member is a length of elastic cord.

3. The pouch of claim 1 wherein the fastening means includes a patch of hook material mounted to one of the cargo pouch and the flap end and a patch of loop material mounted to the other of the cargo pocket and the flap end.

4. The pouch of claim 1 and a length of webbing fixed to the cargo pocket adjacent the open mouth, the webbing for holding the shape of the open mouth.

5. The pouch of claim 1 wherein the first elastic member is a length of elastic band.

* * * * *